United States Patent [19]

Thomas

[11] 4,231,552

[45] Nov. 4, 1980

[54] RESIDENTIAL FENCE

[76] Inventor: Clifford F. Thomas, 286 Main St., Bishop's Falls, Newfoundland, AOHICO

[21] Appl. No.: 909,041

[22] Filed: May 24, 1978

[51] Int. Cl.[3] ..... E04H 17/16

[52] U.S. Cl. ..... 256/24; 256/69

[58] Field of Search ..... 256/24, 25, 27, 29, 256/73, 19, 21, 69

[56] References Cited

U.S. PATENT DOCUMENTS

| | | | |
|---|---|---|---|
| 210,757 | 12/1878 | Davis et al. | 256/19 |
| 829,397 | 8/1906 | Gerber | 256/19 |
| 956,642 | 5/1910 | Klein | 256/19 |
| 2,970,396 | 2/1961 | Worrell | 160/135 X |
| 3,885,765 | 5/1975 | Richards | 403/362 X |
| 4,054,268 | 10/1977 | Sher | 256/24 |

FOREIGN PATENT DOCUMENTS

| | | | |
|---|---|---|---|
| 50909 | 1/1910 | Fed. Rep. of Germany | 256/19 |
| 519854 | 6/1921 | France | 256/19 |

*Primary Examiner*—Wayne L. Shedd
*Attorney, Agent, or Firm*—Howard I. Podell

[57] ABSTRACT

A fence comprising a plurality of rigid, intermediate, vertical support members of generally rectangular construction having longitudinal channels on opposite side walls for receiving vertical plastic or metal panels secured in the channels and terminal or corner vertical supports having longitudinal channels on adjacent side walls in which are secured the edges of the panels.

1 Claim, 3 Drawing Figures

RESIDENTIAL FENCE

FIELD OF THE INVENTION

This invention relates generally to a fence for a residence, public buildings and trailer parks.

THE PRIOR ART

The prior art, as exemplified by U.S. Pat. Nos. 3,698,692; 3,704,005; 3,244,406; 3,770,245; 3,839,834 and 3,963,219 is generally illustrative of various devices of this type. While such devices are generally acceptable for their intended purpose they have not proven to be entirely satisfactory in that they are either complex and expensive to manufacture. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

SUMMARY OF THE INVENTION

This invention resides in a fence comprising a plurality of rigid, intermediate, vertical support members of generally rectangular construction having longitudinal channels on opposite side walls for receiving vertical plastic or metal panels secured in the channels and terminal or corner vertical supports having longitudinal channels on adjacent side walls in which are secured the edges of the panels.

BRIEF DESCRIPTION OF THE DRAWING

In the accompanying drawing, in which is shown one of the various possible illustrative embodiments of this invention, wherein like reference character identify the same or like parts.

DESCRIPTION OF THE PREFERRED EMBODIMENT

Figure 1:
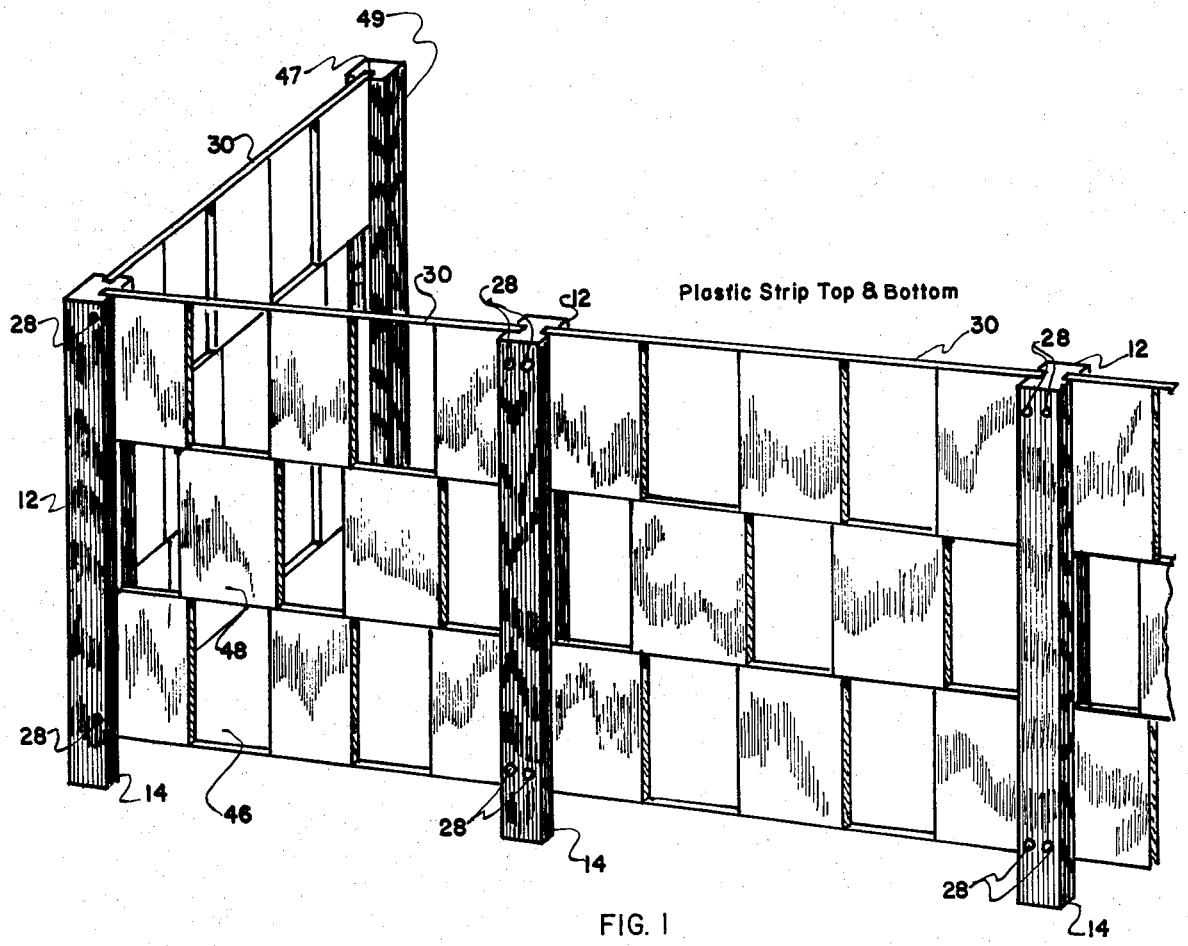
FIG. 1 is an isometric view of a fence according to this invention.
Figure 2:
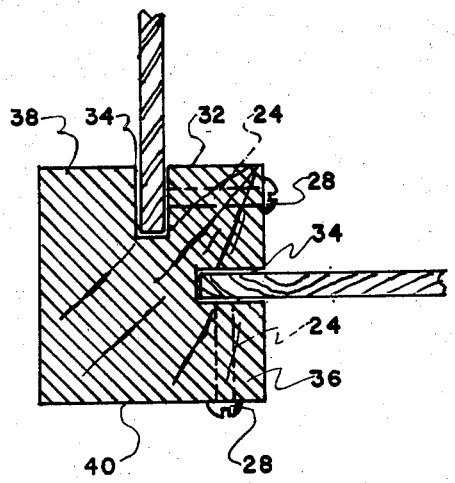
FIG. 2 is a cross-section through a corner supporting member.
Figure 3:
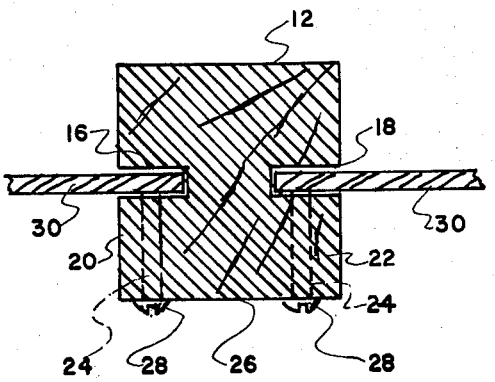
FIG. 3 is a cross-section through an intermediate support member.

With reference to the drawing, there is shown and illustrated a residential fence constructed in accordance with the principles of the invention and designated generally by reference character 10. The fence 10 comprises a plurality of spaced apart rigid, intermediate, support members 12 waving a lower end 14 adapted to be embedded in the ground. Members 12 are of rectangular construction and made of wood, metal or preferably plastic such as impact resistant acrylic resins or polycarbonate resin such as "Lexan" resin. As shown in FIG. 3, members 12 have elongated longitudinal channels 16, 18 on oppositely facing side walls 20, 22 respectively threaded bores 24 are provided in their front wall 26 for the passage of screws 28 which hold outer vertical edges of panels 30 in assembled position in channels 16, 18. This removable arrangement makes possible quick removal of the panels 30 when desired.

Corner supports 32 are identical to the intermediate supports 12 in size, shape and form but have elongated channels 34 on adjacent side walls 36, 38. Bores 24 are provided in front wall 40 and in side wall 36.

Also provided where needed such as for interrupting a fence to allow for a gate or otherwise are terminal support members 49. While identical with the other support members in all respect the terminal members have only one channel 47 on their side wall facing the intermediate or corner supports adjacent thereto.

As shown, the panels can have alternate open 46 and solid 48 parts. Instead of this arrangement, a grill or screen can be used.

The fence can be made from a chip-proof, fade-proof, split-proof, peel-proof plastic or acrylic material. The panels can be painted or dyed two different colors, one on each side. The posts can also be painted or dyed different colors.

The panels and posts can be made in different lengths and heights. The bolts and nuts for holding panels to the posts can be of the same material and color as the posts. By having the panels two different colors, the buyer could change them whenever they preferred. The panels and posts made from acrylic or plastic can be washed off with a damp cloth or hosed down with a waterhose.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefore, a more lengthy description is deemed unnecessary.

It is intended that various changes may be made in this invention in the practical development thereof, if desired. Such changes are comprehended within the meaning and range of equivalency of the following claims. Ths invention, therefore, is not to be restricted except as is necessitated by the prior art.

Having thus described the invention, what is claimed as new and to be secured by Letters Patent is:

1. A fence comprising a plurality of rigid, intermediate vertical supports; said supports being spaced apart; said supports being generally rectangular in cross-section and having longitudinal channels on opposite side walls; and corner and terminal support members each having at least one longitudinal channel therein; vertical panels having edge portions detachably received in said channels and removable clampable fastening means in said support members for securing said edges in said channels, wherein said longitudinal channels extend in a vertical direction in the erect position of a vertical support, with said removable clampable fastening means serving to fix the edge portions of the vertical panels that are received in a channel in a said support member, so that a said received vertical panel is independently fixed in a channel of a single vertical support.

* * * * *